US010750798B2

(12) United States Patent
Goldade

(10) Patent No.: US 10,750,798 B2
(45) Date of Patent: Aug. 25, 2020

(54) HAND WARMER

(71) Applicant: Tracey M. Goldade, Corman Park (CA)

(72) Inventor: Tracey M. Goldade, Corman Park (CA)

( * ) Notice: Subject to any disclaimer, the term of this patent is extended or adjusted under 35 U.S.C. 154(b) by 0 days.

(21) Appl. No.: 16/103,017

(22) Filed: Aug. 14, 2018

(65) Prior Publication Data

US 2019/0053549 A1 Feb. 21, 2019

Related U.S. Application Data

(60) Provisional application No. 62/545,702, filed on Aug. 15, 2017.

(51) Int. Cl.
*A41D 13/08* (2006.01)

(52) U.S. Cl.
CPC ..... *A41D 13/081* (2013.01)

(58) Field of Classification Search
CPC ..... A41D 13/081
USPC ..... 2/16
See application file for complete search history.

(56) References Cited

U.S. PATENT DOCUMENTS

| | | | | | |
|---|---|---|---|---|---|
| 4,495,659 | A * | 1/1985 | Madnick | A41D 13/081 | 2/66 |
| 4,949,887 | A * | 8/1990 | Holmes | A41D 13/081 | 126/204 |
| 5,241,706 | A * | 9/1993 | Netz | A41D 13/0537 | 2/267 |
| 5,269,023 | A * | 12/1993 | Ross | A41D 13/081 | 126/204 |
| 5,499,401 | A * | 3/1996 | Heinmiller | A41D 13/081 | 2/208 |
| 5,953,758 | A | 9/1999 | Foster | | |
| 6,477,711 | B1 | 11/2002 | Freeman et al. | | |
| 8,615,814 | B1 * | 12/2013 | Hawkins | A41D 13/081 | 2/66 |
| 8,667,613 | B2 | 3/2014 | Blakely et al. | | |
| 9,295,292 | B2 | 3/2016 | Sachs | | |
| 9,554,601 | B2 | 1/2017 | Arajakis | | |
| 2010/0175161 | A1 | 7/2010 | Jarboe | | |
| 2012/0042428 | A1 | 2/2012 | Jarboe | | |
| 2012/0151655 | A1 | 6/2012 | Jarboe | | |
| 2018/0192753 | A1 | 7/2018 | Jarboe | | |

* cited by examiner

*Primary Examiner* — Gloria M Hale
(74) *Attorney, Agent, or Firm* — Dinsmore & Shohl LLP

(57) ABSTRACT

An element defines an aperture, is insulative and has a muff configuration wherein: the element defines a tubular body sized and dimensioned to permit a user to manipulate a phone interiorly of the tubular body; and the aperture permits the phone to be viewed in the course of such manipulation.

9 Claims, 6 Drawing Sheets

HAND WARMER

CROSS-REFERENCE TO RELATED APPLICATIONS

The present application claims the priority of U.S. Ser. No. 62/545,702 filed Aug. 15, 2018, the contents of which are incorporated by reference.

FIELD OF THE INVENTION

The present invention discloses a hand warmer.

BACKGROUND OF THE INVENTION

A muff is a tube, often made of fur or similar insulative material, into which a person may insert his or her hands for warmth in cold environments.

SUMMARY OF THE INVENTION

Forming one aspect of the present invention is an apparatus having an element. The element defines an aperture, is insulative and has a muff configuration wherein the element defines a tubular body sized and dimensioned to permit a user to manipulate a phone interiorly of the tubular body. The aperture also permits the phone to be viewed in the course of such manipulation.

According to another aspect of the invention, the apparatus can further include an insulative structure secured to the element which, in the muff configuration of the element, is disposed interiorly of the body and has a viewing configuration, relatively distal to the aperture, to define in combination with the element, a viewing muff in which the phone can be manipulated by a user and viewed through the aperture as aforesaid and wherein the hands of the user are partially encircled with insulation. The apparatus also provides a non-viewing configuration, relatively proximal to the aperture, to define in combination with the element, a warming muff in which the hands can be placed to be fully encircled with insulation.

According to another aspect of the invention, the element can have opposed zippered ends which, in the muff configuration, are secured to one another and have a seat configuration, and wherein the zippered ends are disengaged from one another and the element is generally planar and adapted to serve as a seat cushion.

According to another aspect of the invention, the insulative structure can be a sleeve which is secured to the element along a pair of seams, the sleeve in the muff configuration of the element being generally concentric with the body and the seams in the muff configuration of the element being aligned generally parallel with the axes of the body and the sleeve.

According to another aspect of the invention, the apparatus can further include a flexible transparent plastic panel occluding the aperture.

According to another aspect of the invention, the apparatus can further include a drawstring pocket, the drawstring pocket being adapted to releasably hold a conventional heating pack and being secured to the element so as to be positioned, when the element is in the muff configuration and the insulative structure is in the non-viewing configuration, in the warming muff.

According to another aspect of the invention, the element defines a pocket which, when the element is disposed in the muff configuration, presents exteriorly to the body.

According to another aspect of the invention, the apparatus can further include a zipper secured to the element and adapted to releasably close the pocket.

According to another aspect of the invention, the apparatus can further include a pair of lugs secured to the element such that, when the element is disposed in the muff configuration, the muffs are disposed at opposite ends of the body.

According to another aspect of the invention, the element can have a waterproof surface which, when the element is disposed in the muff configuration, defines the exterior surface of the body.

Forming another aspect of the invention is an apparatus including an element, the element being insulative and having a muff configuration wherein the element defines a tubular body sized and dimensioned to receive the hands of a user, and wherein the element has opposed zippered ends which, in the muff configuration, are secured to one another; and has a seat configuration, wherein the zippered ends are disengaged from one another and the element is generally planar and adapted to serve as a seat cushion.

Additional advantages, features and characteristics of the present invention will become apparent upon a review of the following detailed description with reference to the accompanying drawings, the latter being briefly described hereinafter.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
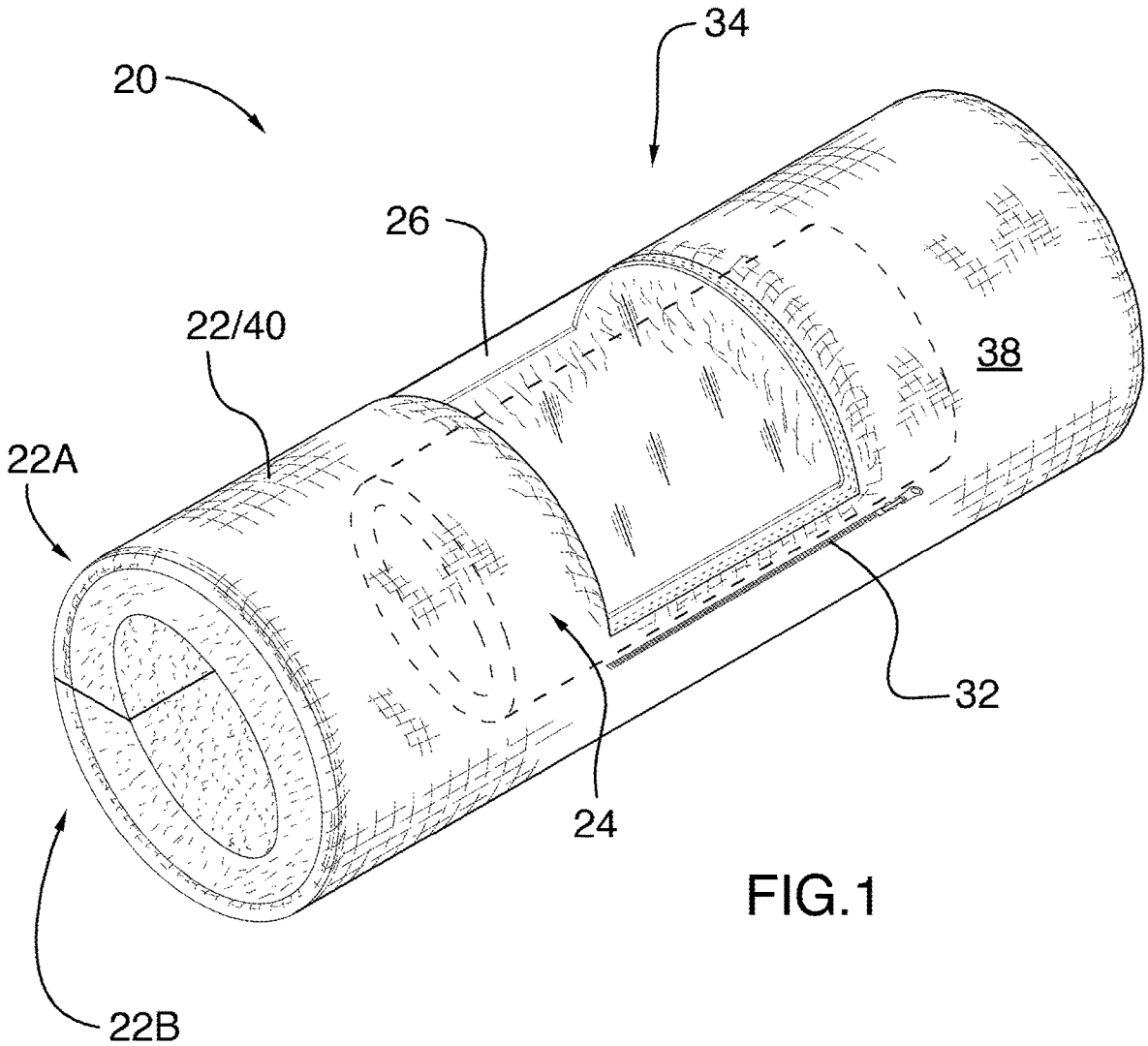
FIG. 1 is a perspective view of apparatus according to an exemplary embodiment of the invention, the view showing, inter alia, the element in the muff configuration.
Figure 2:
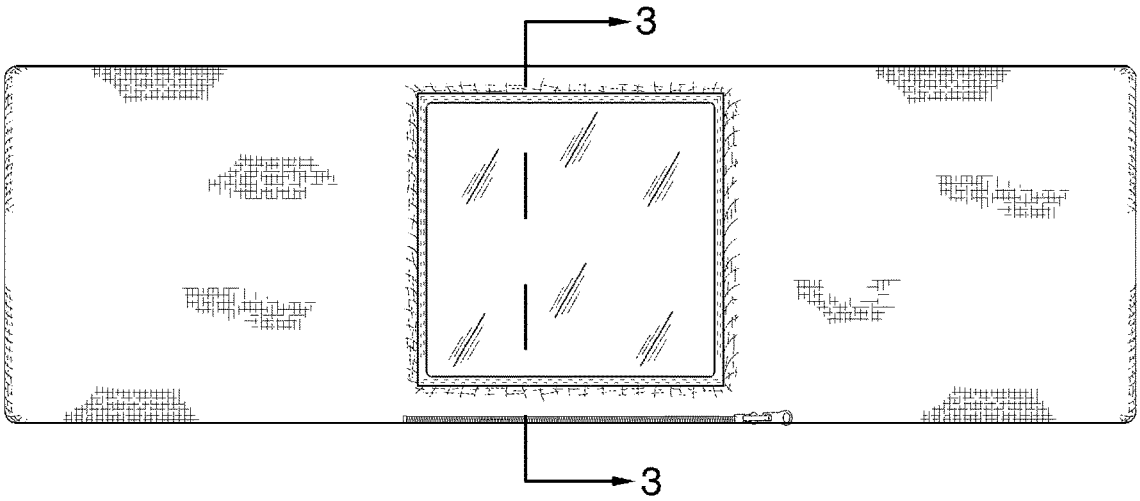
FIG. 2 is a top view of the apparatus.
Figure 3:
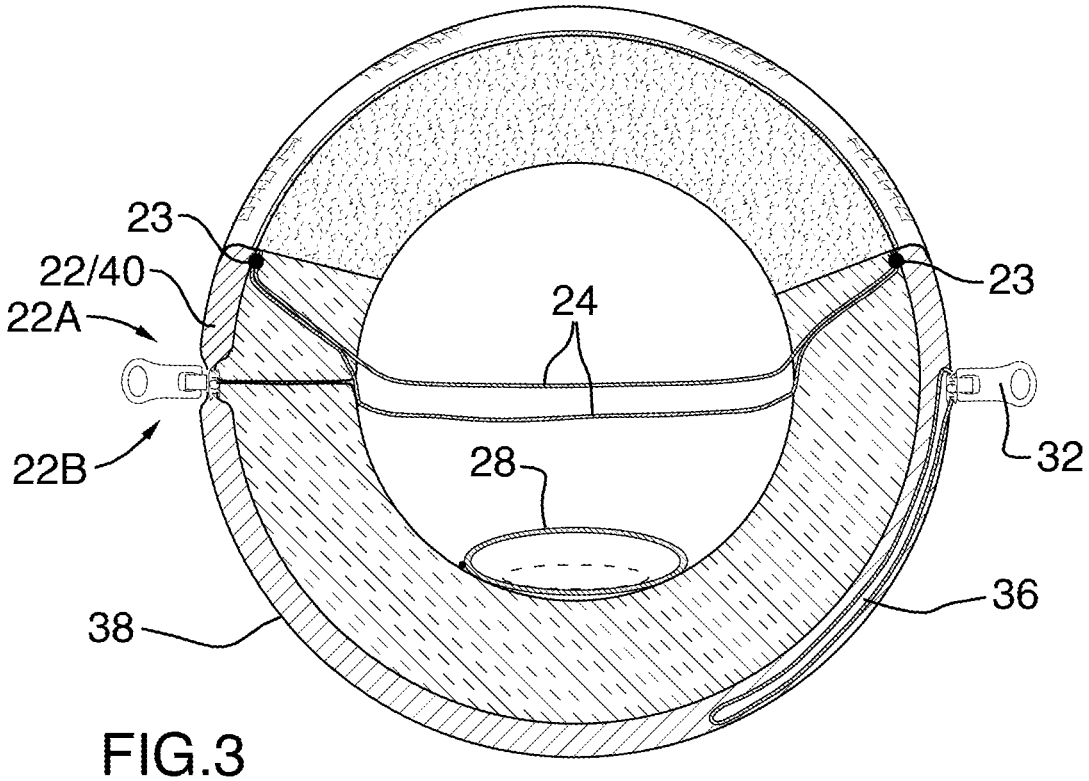
FIG. 3 is a view along section 3-3 of FIG. 2.
Figure 7:
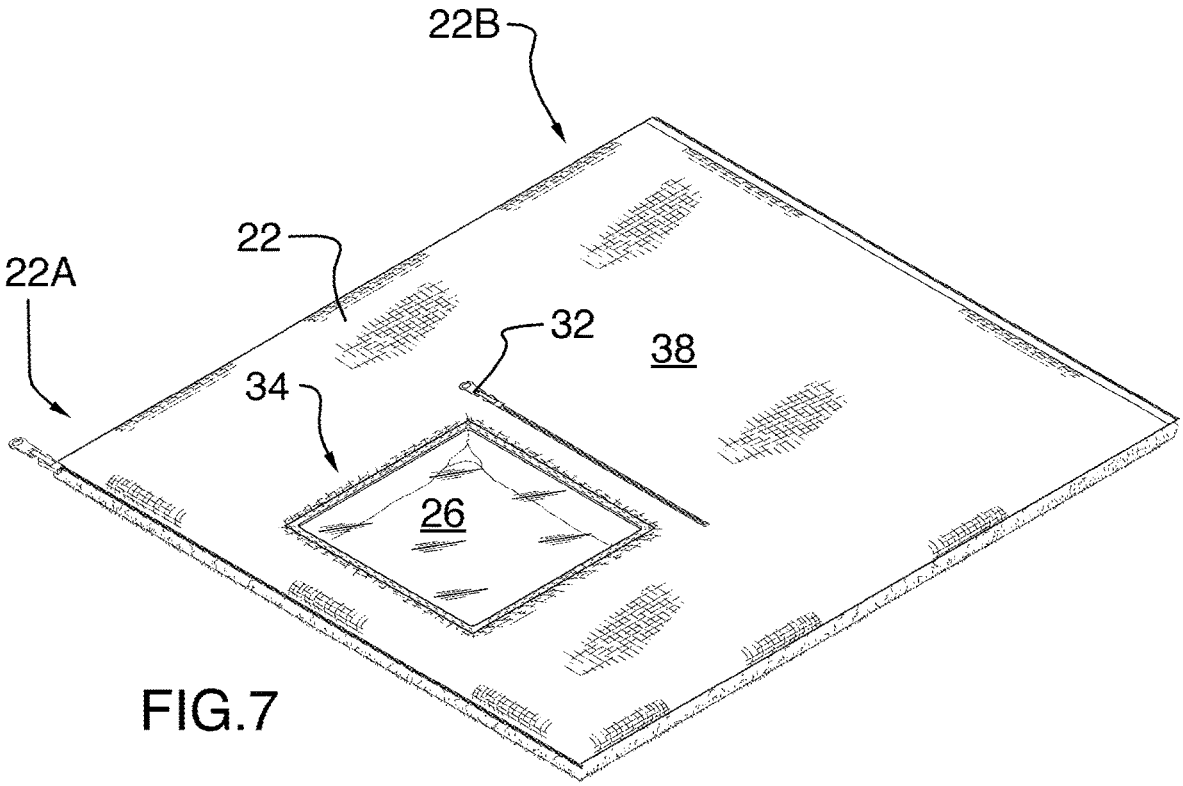
FIG. 7 is a view of the apparatus, showing the element in the seat configuration.

With reference now to FIG. 1 et seq., the present invention illustrates an apparatus 20 according to an exemplary embodiment of the invention. The apparatus 20 includes each an element 22, an insulative structure 24, a panel 26, a drawstring pocket 28 (FIG. 3), a pair of lugs 30 (FIG. 8) and a zipper 32 (see also FIGS. 3 and 7).

The element 22 is insulative, defines an aperture 34, has opposed zippered ends 22A, 22B (these best shown in FIG. 3), defines a pocket 36 and has a waterproof surface 38.

The insulative structure 24 is a sleeve secured to the element 22 along a pair of seams 23 and has elastic, gathered ends 40. The panel 26 occludes the aperture 34 and is constructed of flexible transparent plastic.

Figure 8:
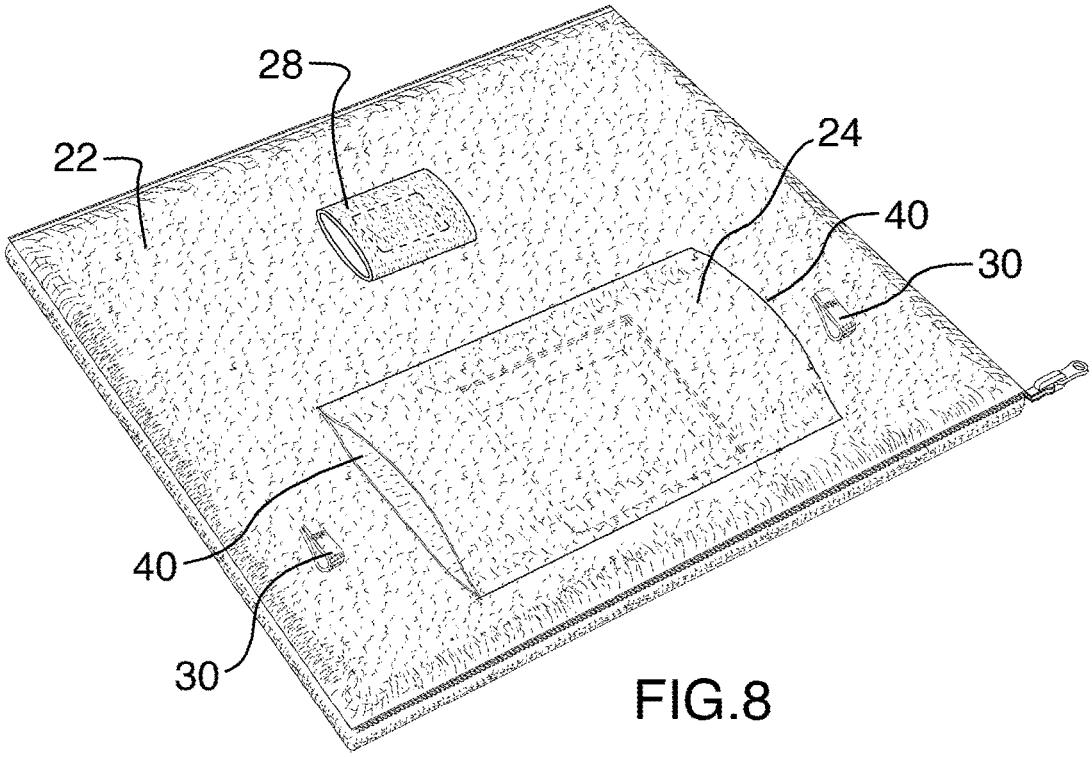
FIG. 8 is a view of the structure of FIG. 7 from another vantage point.
Figure 9:
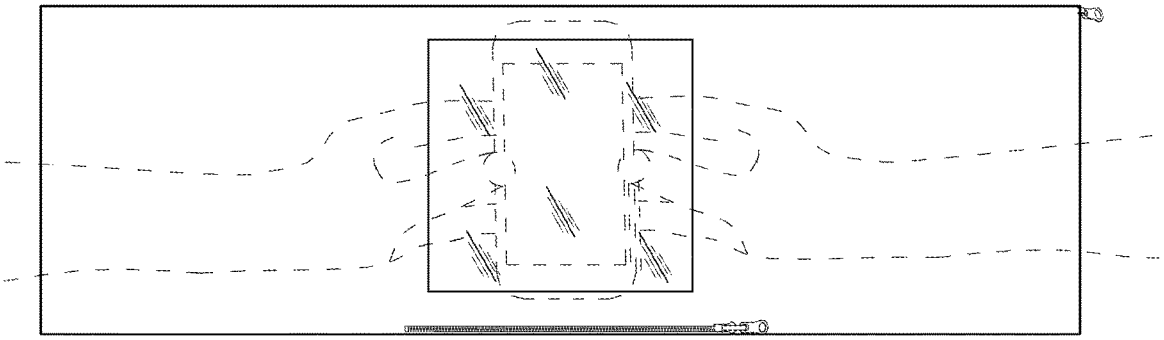
FIG. 9 is a view of the structure of FIG. 1 in use, with the insulative structure in the viewing configuration.
Figure 10:
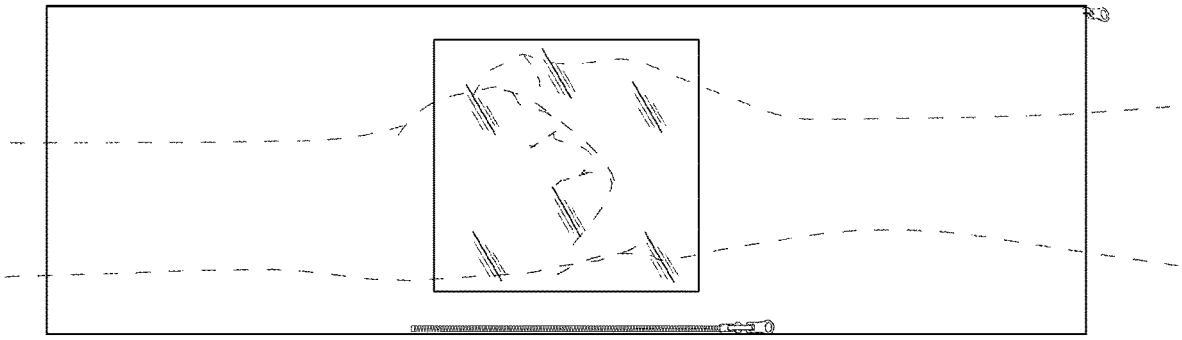
FIG. 10 is a view of the structure of FIG. 1 in use, with the insulative structure in the non-viewing configuration.
Figure 11:
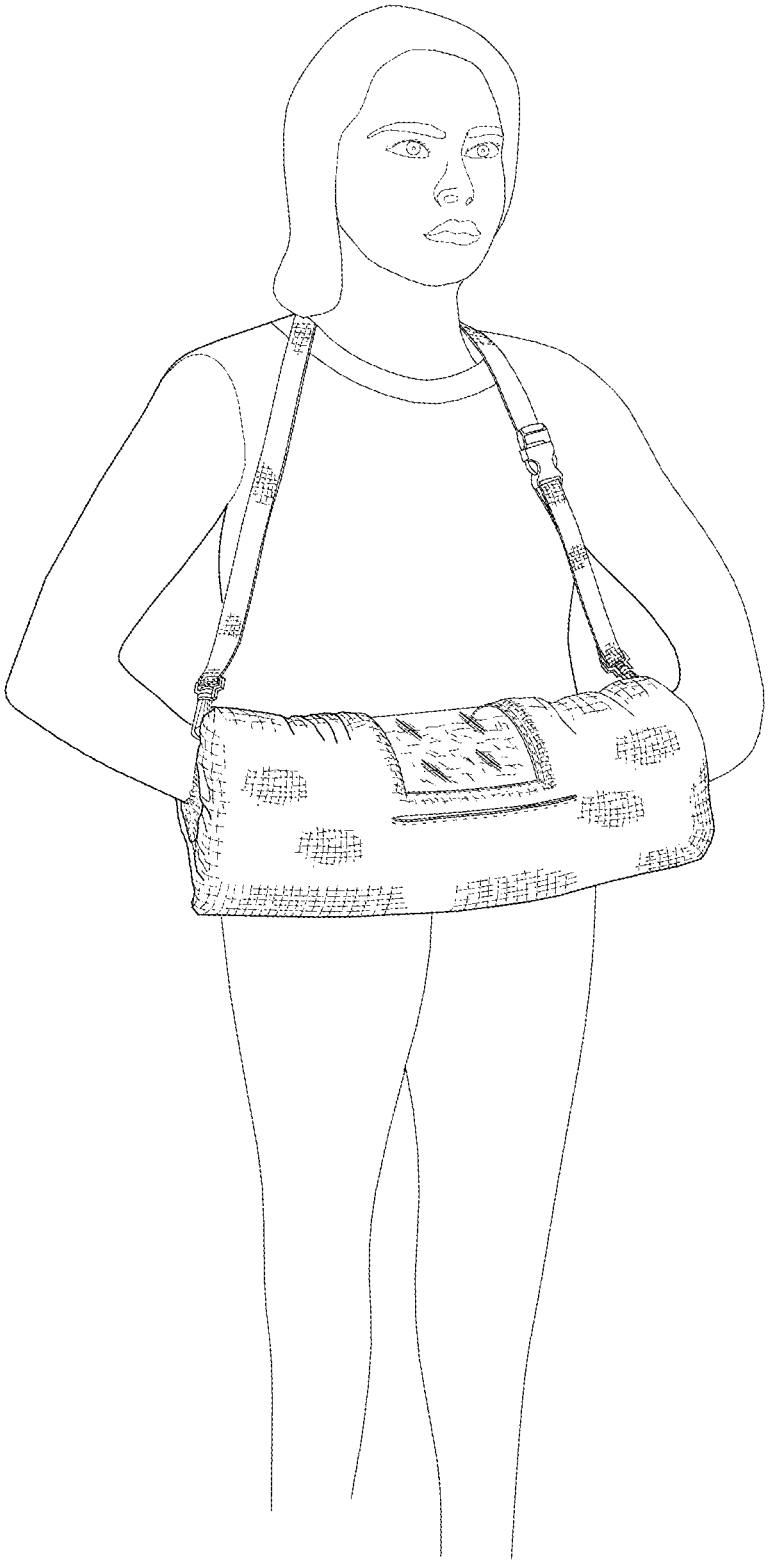
FIG. 11 is a view of the structure of FIG. 1 in use.

The drawstring pocket 28 is secured is adapted to releasably hold a heating pack and is secured to the element 22. The lugs 30 are secured at opposite ends of the element 22. The zipper 32 is secured to the element and is adapted to releasably close the pocket 36 and to convert the apparatus 20 from the flattened configuration of FIGS. 7-8 to the use configuration of FIG. 1. Accordingly, the element 22 will be understood to have a muff configuration as shown in FIGS. 1-6, 9 and 10 and a seat configuration as shown in FIG. 8.

In the muff configuration, the zippered ends 22A, 22B are secured to one another such that the element defines a tubular body 40. The waterproof surface 38 defines the exterior surface of the body 40. The insulative sleeve 24 is disposed interiorly of and generally concentric to the body 40. The seams 23 are aligned generally parallel with the axes of the body 40 and the sleeve 24. The lugs 30 are disposed at opposite ends of the body 40. The pocket 36 presents exteriorly to the body 40, and the insulative sleeve 24 has a non-viewing configuration shown in FIG. 4 and a viewing configuration shown in FIG. 5.

Figure 4:
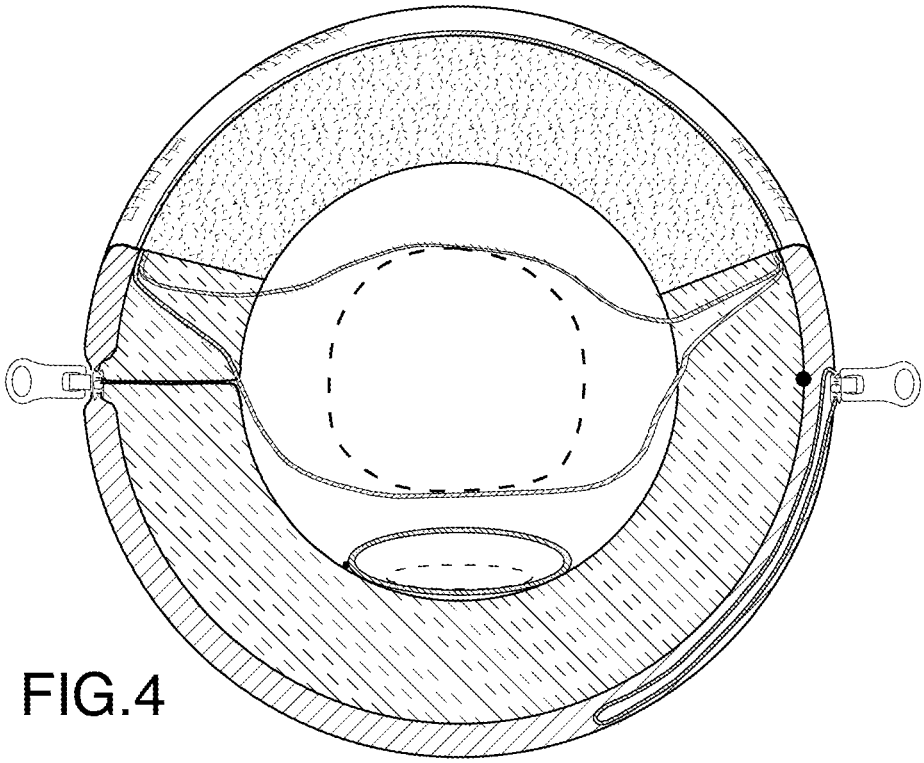
FIG. 4 is a view similar to FIG. 3 showing the insulative structure in the non-viewing configuration.

In the non-viewing configuration shown in FIG. 4, the sleeve 24 is relatively proximal to the aperture, to define in combination with the element, a warming muff in which the hands of a user (which is shown in phantom) can be placed to be fully encircled with insulation. To further enhance the warmth of the user, a conventional heating pack can be fitted in the drawstring closure. A further non-viewing configuration is also possible, as is further shown in FIG. 6.

Figure 5:
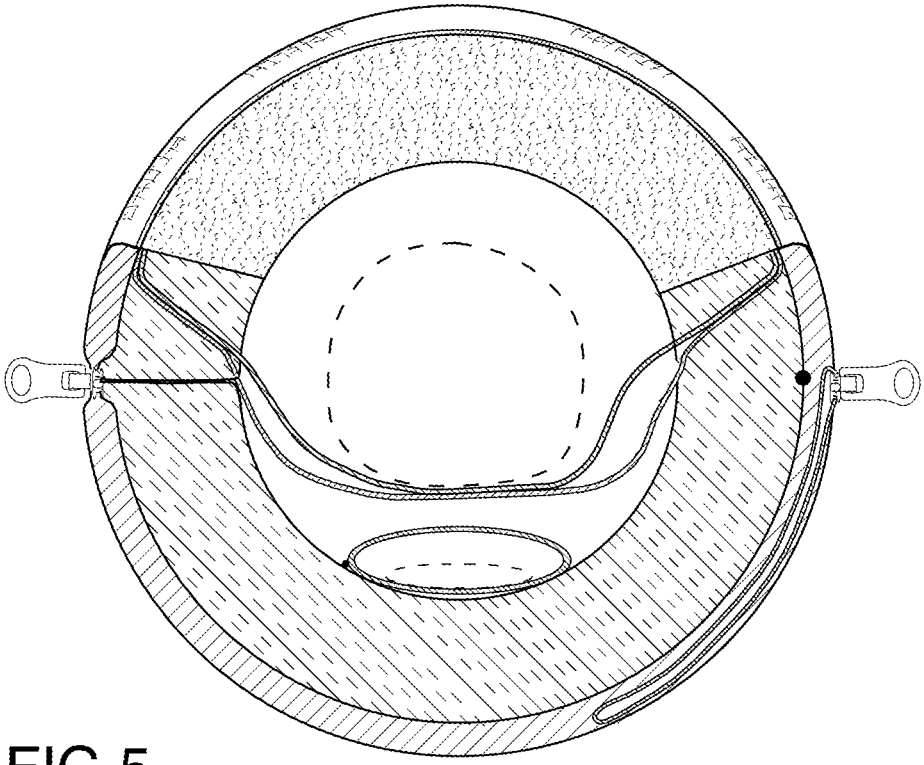
FIG. 5 is a view similar to FIG. 3 showing the insulative structure in a viewing configuration.
Figure 6:
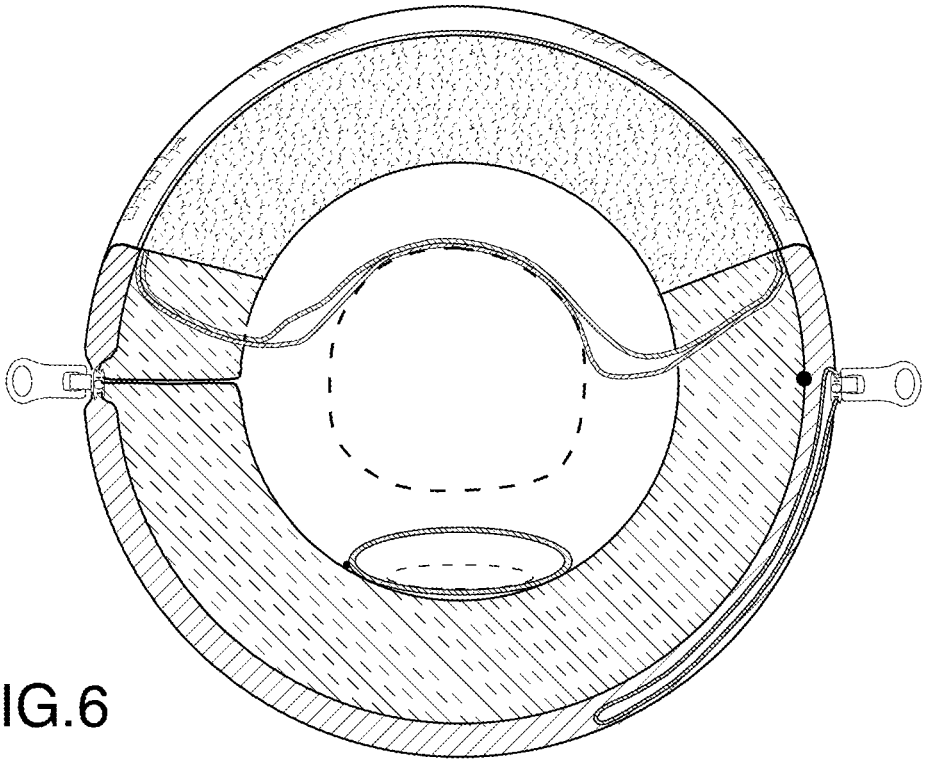
FIG. 6 is a view similar to FIG. 3 showing the insulative structure in a further non-viewing configuration.

In the viewing configuration shown in FIG. 5, the sleeve 24 is relatively distal to the aperture, to define in combination with the element 22, a viewing muff in which a phone can be manipulated by a user and viewed through the aperture wherein the hands of the user are partially encircled with insulation. Notably, the insulative structure 24 is dimensioned such that the hands of the user need not exit the body 40 when transitioning between the viewing and non-viewing configurations.

In the seat configuration, the zippered ends 22A, 22B are disengaged from one another and element 22 is generally planar and adapted to serve as a seat cushion (reference again being made to FIGS. 7-8).

Persons of ordinary skill will readily appreciate the advantage associated with apparatus that allows users to keep hands warm in cold environments, while enabling phones to be viewed and manipulated, that is relatively easy to carry by a shoulder strap by virtue of the lugs, that can service as a seat cushion when necessary, that has a zippered pocket to store keys and the like.

Whereas a specific embodiment is herein shown and described, it will be understood that variations are possible. For example, only, whereas zippers are mentioned, other closures, such as hook and loop, could be used. As well, whereas both a window and a zipper are shown, either can be omitted. Accordingly, the invention should be understood to be limited only by the accompanying claims, purposively construed.

I claim:

1. An apparatus for use with a phone, the apparatus comprising:

an element;

having a muff configuration and a seat configuration;

defining an aperture in both the muff configuration and the seat configuration; and being insulative, wherein the element defines a tubular body sized and dimensioned to permit, when the phone is positioned interiorly of the tubular body, a user to manipulate the phone;

the aperture permits the phone to be viewed during such manipulation;

the element has opposed zippered ends which, in the muff configuration, are secured to one another; and in the seat configuration, the zippered ends are disengaged from one another and the element is generally planar and adapted to serve as a seat cushion.

2. The apparatus according to claim 1, further comprising an insulative structure secured to the element and which, in the muff configuration of the element, is disposed interiorly of the body and has:

a viewing configuration, relatively distal to the aperture, to define in combination with the element, a viewing muff in which the phone can be manipulated by a user and viewed through the aperture as aforesaid and wherein the hands of the user are adapted to being partially encircled with the insulative structure; and a non-viewing configuration, relatively proximal to the aperture, to define in combination with the element, a warming muff in which the hands are adapted to being placed so as to be fully encircled with the insulative structure.

3. The apparatus according to claim 1, wherein the body has an axis; and the insulative structure is a sleeve having an axis, the sleeve being secured to the element along a seam, the sleeve in the muff configuration of the element being generally concentric with the body and the seam in the muff configuration of the element being aligned generally parallel with the axes of the body and the sleeve.

4. The apparatus according to claim 1, further comprising a flexible transparent plastic panel occluding the aperture.

5. The apparatus according to claim 1, further comprising a drawstring pocket, the drawstring pocket being adapted to releasably hold a heating pack and being secured to the element so as to be positioned, when the element is in the muff configuration and the insulative structure is in the non-viewing configuration, in the warming muff.

6. The apparatus according to claim 1, wherein the element defines a pocket which, when the element is disposed in the muff configuration, is exterior to the body.

7. The apparatus according to claim 6, further comprising a zipper secured to the element and adapted to releasably close the pocket.

8. The apparatus according to claim 1, further comprising a pair of lugs secured to the element such that, when the element is disposed in the muff configuration, the muffs are disposed at opposite ends of the body.

9. The apparatus according to claim 1, wherein the element has a waterproof surface which, when the element is disposed in the muff configuration, defines the exterior surface of the body.

* * * * *